US005389729A

United States Patent [19]

Hiramatsu

[11] Patent Number: 5,389,729

[45] Date of Patent: Feb. 14, 1995

[54] TONE SIGNAL GENERATOR ADAPTED FOR COUPLING WITH PERSONAL COMPUTER

[75] Inventor: Mikihiro Hiramatsu, Hamamatsu, Japan

[73] Assignee: Yamaha Corporation, Japan

[21] Appl. No.: 4,072

[22] Filed: Jan. 13, 1993

[30] Foreign Application Priority Data

Jan. 14, 1992 [JP] Japan ..... 4-004993

[51] Int. Cl.[6] ..... G10H 1/00

[52] U.S. Cl. ..... 84/601; 84/645

[58] Field of Search ..... 84/601, 602, 645

[56] References Cited

U.S. PATENT DOCUMENTS 4,662,261 5/1987 Akutsu .

4,945,806 8/1990 Merrill, Jr. ..... 84/645

5,208,421 5/1993 Lisle et al. ..... 84/645

5,262,580 11/1993 Tanaka et al. ..... 84/602

FOREIGN PATENT DOCUMENTS 1036282A 10/1989 China .

3-291698 12/1991 Japan .

*Primary Examiner*—Stanley J. Witkowski

*Attorney, Agent, or Firm*—Graham & James

[57] ABSTRACT

A tone signal generator unit having both a bi-directional interface such as RS-232C and a MIDI interface. The tone signal generator unit converts data format to allow direct connection to a personal computer and to another electronic musical instrument, without using a specific MIDI board on the side of the personal computer.

7 Claims, 8 Drawing Sheets

14

15

TONE SIGNAL GENERATOR ADAPTED FOR COUPLING WITH PERSONAL COMPUTER

BACKGROUND OF THE INVENTION a) Field of the Invention

The present invention relates to a tone signal generator for generating tone signals of inputted musical performance data, and more particularly to a tone signal generator equipped with a plurality type of input/output interfaces.

b) Description of the Related Art

A musical instrument digital interface (MIDI) is widely used nowadays for the transfer of electric signals such as musical performance data. MIDI provides unidirectional transmission of data having a predetermined format via a cable with 5-pin DIN output and input connectors.

Software of personal computers for editing tone colors or automatic musical performance data is also known in practical use. Although personal computers have generally a built-in bi-directional serial interface such as RS-232 and RS-422, personal computers provided with a MIDI connector (5-pin DIN connector) is rare.

Under such an environment, it is necessary to insert a MIDI interface board into a slot of a personal computer for the data conversion of edited tone colors and musical performance data and for the data transfer to and from an electronic musical instrument via a MIDI connector cable. Mounting and connections of such a board and cable requires some labor and results in high cost.

SUMMARY OF THE INVENTION

It is an object of the present invention to provide a tone signal generator allowing an easy access to a personal computer and other electronic musical instruments (including a musical performance controller).

According to one aspect of the present invention, there is provided a tone signal generator comprising a tone signal generator circuit for generating tone signals of input musical performance data, general bi-directional serial communication means for transmitting and receiving information including musical performance data to and from a personal computer, electronic musical instrument serial communication means including serial input means for receiving information inclusive of musical performance data from an electronic musical instrument and serial output means for transmitting information inclusive of musical performance data to another electronic musical instrument, and repeater means for outputting said information input from said bi-directional serial communication means to said serial output means and for outputting said information input from said serial input means to said bi-directional serial communication means.

Preferably, the tone signal generator is provided with switching means for switching between producing and not producing a musical tone from the tone signal generator circuit, the musical tone representing musical performance data input from the bi-directional serial communication means or the serial input means.

The bi-directional serial communication means may be RS-232, RS-422, or the like. The electronic musical instrument serial communication means is MIDI. The tone signal generator circuit can synthesize tone signals by using musical performance data supplied via any one of the communication means, using its repeater means. Data supplied from the personal computer is converted into data of the other format and sent to the musical instrument, or vice versa. It is therefore possible to connect the tone signal generator or unit to a personal computer or the like without adding a MIDI board to the personal computer. It is also possible to provide connections between other electronic musical instruments, personal computers, and the like, via the tone signal generator unit. Use of the switching means allows the tone signal generator circuit not to generate musical tones of input musical performance data, using the tone signal generator only as a repeater.

The tone signal generator of the present invention is provided with the general bi-directional serial communication means, electronic musical instrument serial communication means, and switching means. Therefore, musical performance data or the like can be transferred by directly connecting a personal computer to the tone signal generator, and data received from an electronic musical instrument can be transmitted to the personal computer.

DETAILED DESCRIPTION OF THE PREFERRED EMBODIMENTS

Figure 1A:
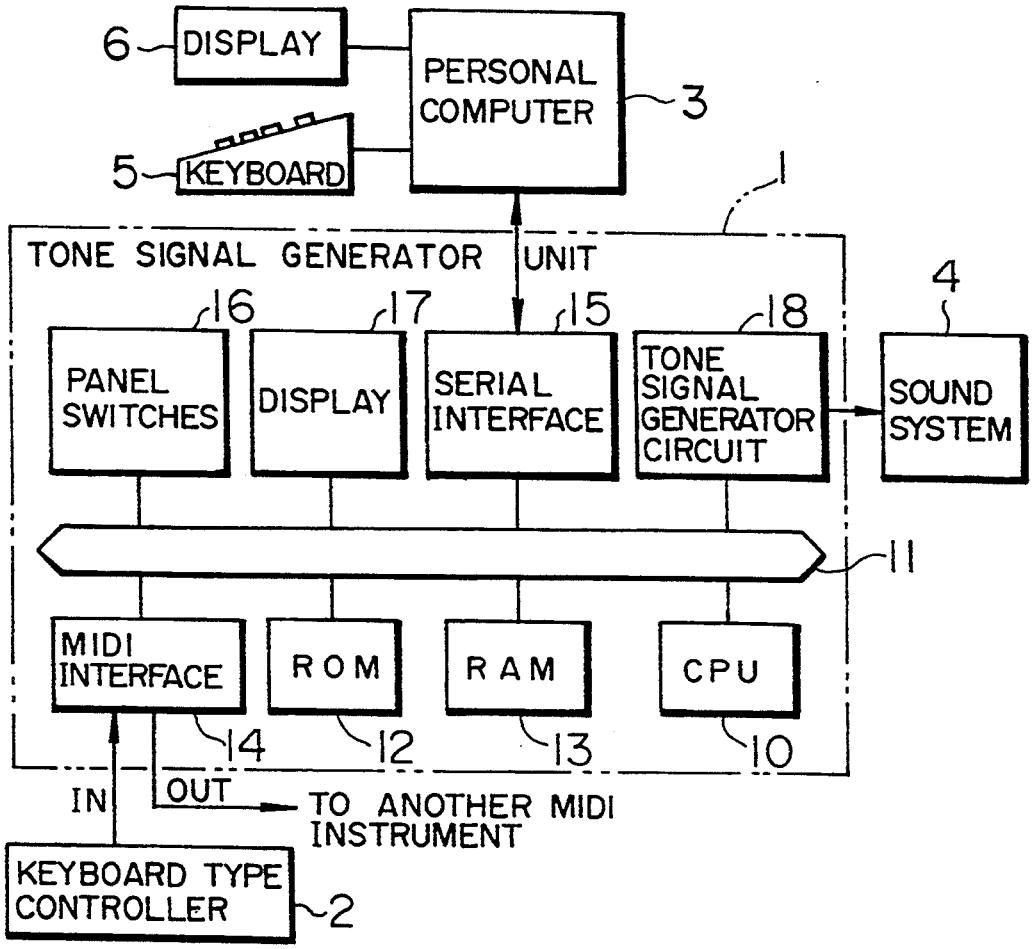
FIGS. 1A–C shows the structure of a tone signal generator unit according to an embodiment of the present invention.
Figure 1B:
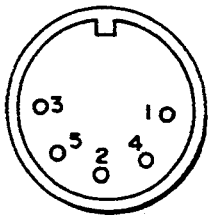
Figure 1C:
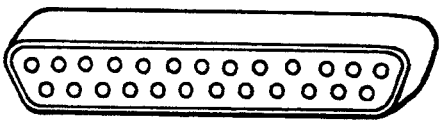

FIGS. 1A–C is a block diagram showing the structure of a tone signal generator unit according to an embodiment of the present invention.

This tone signal generator unit generates tone signals of performance data input via interfaces from other electronic musical instruments and personal computers or the like. The tone signal generator unit can change tone colors, effects, and the like, in accordance with the wide range of commands received from other instruments.

The tone signal generator unit 1 is connected with a personal computer 3 and sound system 4. A keyboard type controller 2 is connected via a MIDI cable to a MIDI interface 14 of the tone signal generator unit 1, and the personal computer 3 is connected to via a bi-directional communication cable to a serial interface 15. An example of a connector for coupling to the MIDI interface is shown in FIG. 1B. The serial interface is a general bi-directional serial interface such as RS-232C and RS-422 whose connector is shown in FIG. 1C by way of example. The tone signal generator unit 1 is controlled by a CPU 10. CPU 10 is connected via a bus 11 to a ROM 12, RAM 13, MIDI interface 14, serial interface 15, panel switches 16, display 17, and tone signal generator circuit 18. The tone signal generator circuit 18 generates tone signals of musical performance data stored in a buffer BUF in RAM 13, under control of CPU 10. A sound system 4 connected to the tone signal generator circuit 18 amplifies input tone waveform signals and outputs them from loudspeakers or the like. ROM 12 stores control programs for various controls illustrated by flow charts to be described later. RAM 13 has the above-described buffer BUF for storing various data input via the interfaces, a communication mode flag register CM for storing communication mode flags to be used in setting a communication mode, a note register NC for storing note numbers, a velocity register NC for storing velocity data, a channel register i for storing channel numbers, a tone color register TCi for storing tone color data corresponding to channel numbers i, a program number register PC for storing program numbers, and an operation mode register OM for storing operation modes. The panel switches 16 are used in locally switching between tone colors, effects, and the like. The display 17 displays a tone color or mode presently set.

FIGS. 2 to 5 are flow charts illustrating the operations of the tone signal generator unit.

Figure 2:
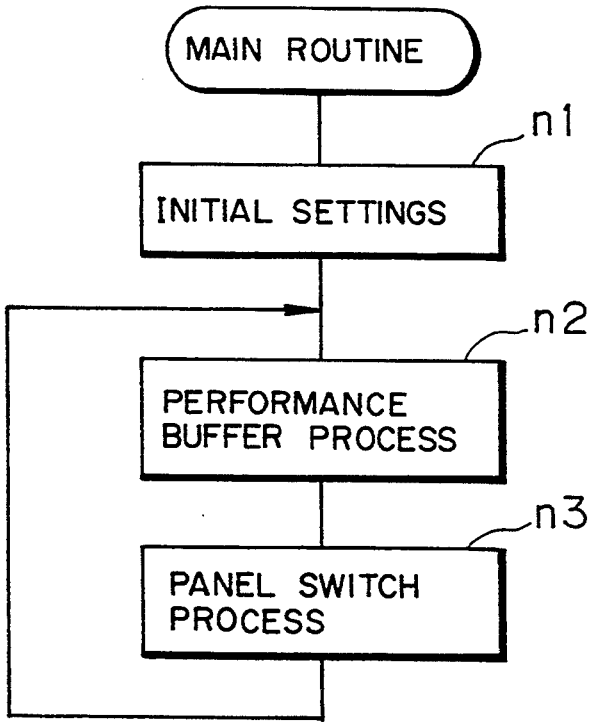
FIG. 2 is a flow chart showing the main routine of the operation to be executed by the tone signal generator unit of the embodiment.

FIG. 2 is a flow chart of the main routine to be executed by the tone signal generator unit. Initialization is executed at step n1 to enter the tone signal generator unit 1 into a standby state. Thereafter, a reception buffer process (step n2) and panel switch process (step n3) are repetitively executed. The panel switch process includes an operation of switching between tone colors and communication modes for each MIDI channel, an operation of renewing the program change table, an operation of dumping data of the tone signal generator unit to the personal computer.

Figure 3:
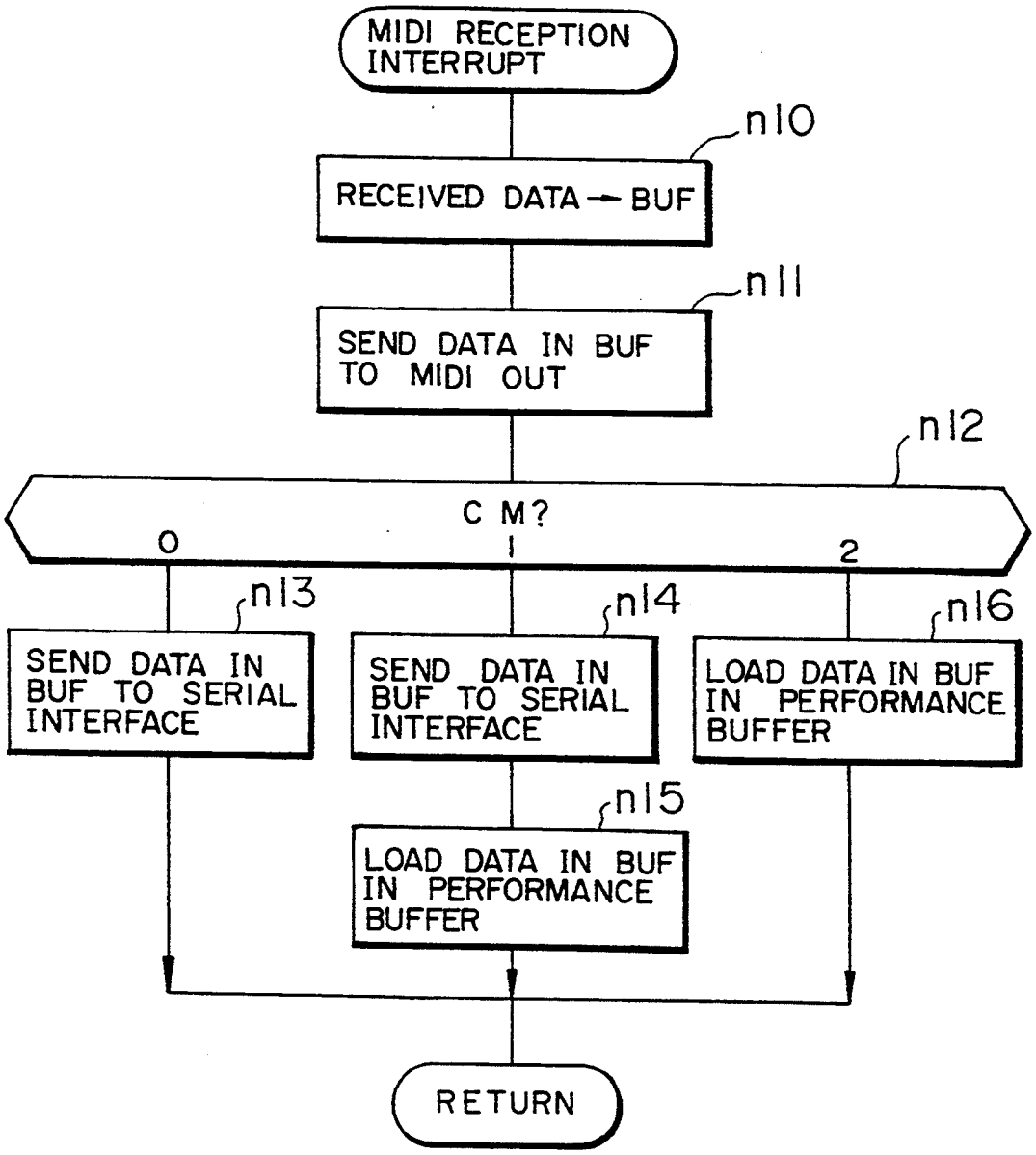
FIG. 3 is a flow chart showing a MIDI reception interrupt operation of the tone signal generator unit of the embodiment.

FIG. 3 is a flow chart showing the MIDI reception interrupt operation initiated when serial data is received from a MIDI IN terminal of the MIDI interface 14. When data is received from another electronic musical instrument via the MIDI interface 14, the received data is loaded in the buffer BUF (step n10). Data in BUF is transmitted via a MIDI OUT terminal (step n11), and a communication flag CM is discriminated (step n12). CM=0 is a mode wherein the received data is converted to the other data format to output it to the serial interface 15, without generating tone signals of the received data from the tone signal generator circuit 18. CM=1 is a mode wherein the received data is converted to the other data format to output it to the serial interface, and the received data is reproduced as sounds. CM=2 is a mode wherein the received data is reproduced as sounds, without outputting the data to the serial interface 15. Therefore, if the communication mode is CM=0, data in BUF is converted to the other format and outputted to the serial interface 15 (step n13). If the communication mode is CM=1, data in BUF is converted to the other format and outputted to the serial interface 15 (step n14), and the data in BUF is loaded in a performance data buffer in which data is transmitted to the tone signal generator circuit 18 (step n15). If the communication mode is CM=2, data in BUF is loaded in the performance data buffer (n16).

Figure 4:
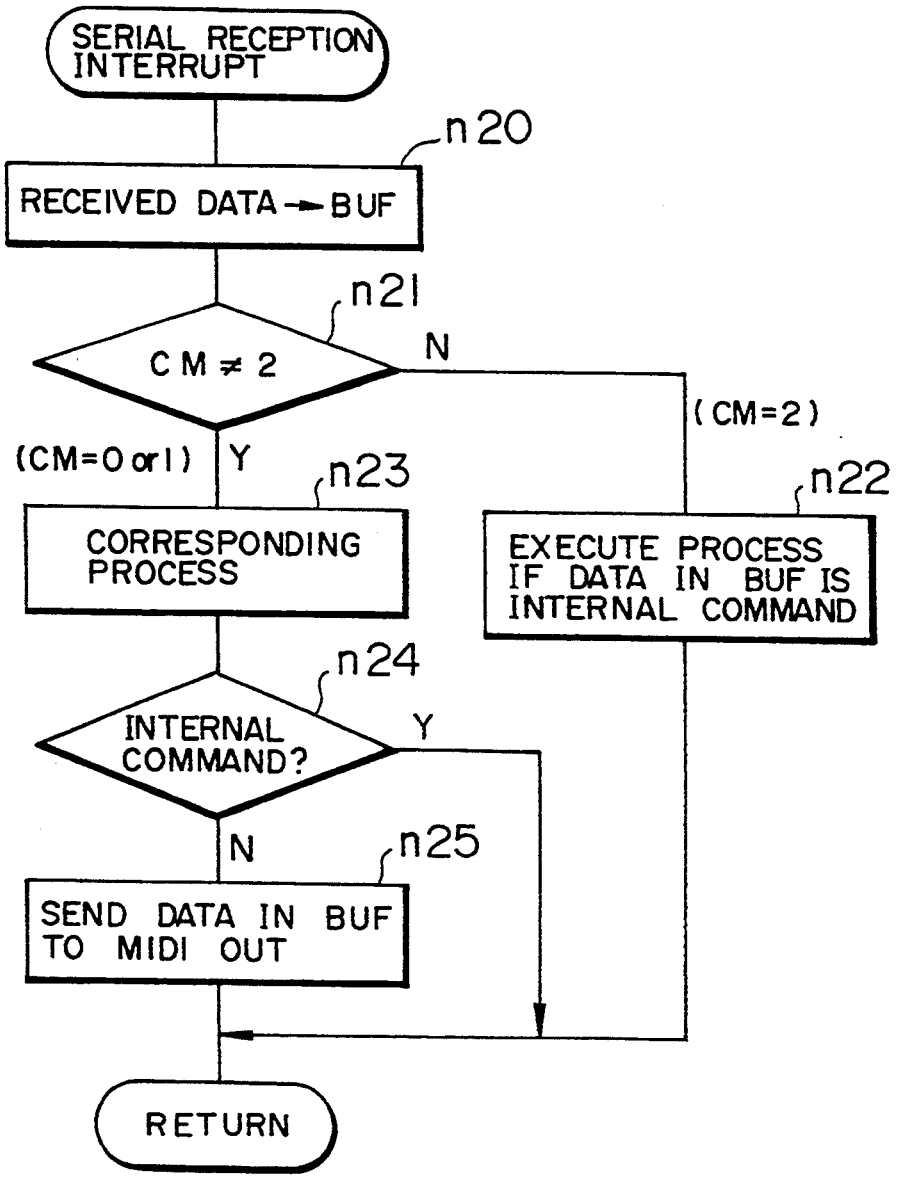
FIG. 4 is a flow chart showing a serial reception interrupt operation of the tone signal generator unit of the embodiment.

FIG. 4 is a flow chart of a serial reception interrupt routine which is initiated when data is received from the serial interface 15. Received data is loaded in BUF (step n20). Next, the communication mode CM is discriminated (step n21). When data is received from the serial interface 15, internal commands are executed in any communication mode, and sounds are reproduced in modes CM=0 and CM=1. The internal commands are so-called system exclusive commands which are stipulated only between the personal computer 3 and tone signal generator unit 1, such as a program change command and a mode change command. If the discriminated communication mode is CM=2 and only if data loaded in BUF is an internal command, an operation corresponding to the internal command is performed (step n22). If the mode is not CM=2, an operation corresponding to the data in BUF is performed, irrespective of the contents of the loaded data. Specifically, the data in BUF is loaded in the performance data buffer, and if the data in BUF is an internal command, an operation corresponding to the internal command is performed. If the data in BUF is musical performance data, sounds are generated by the tone signal generator circuit 18 (step n23), and the performance data is outputted from the MIDI OUT terminal (steps n24 and n25).

Figure 5:
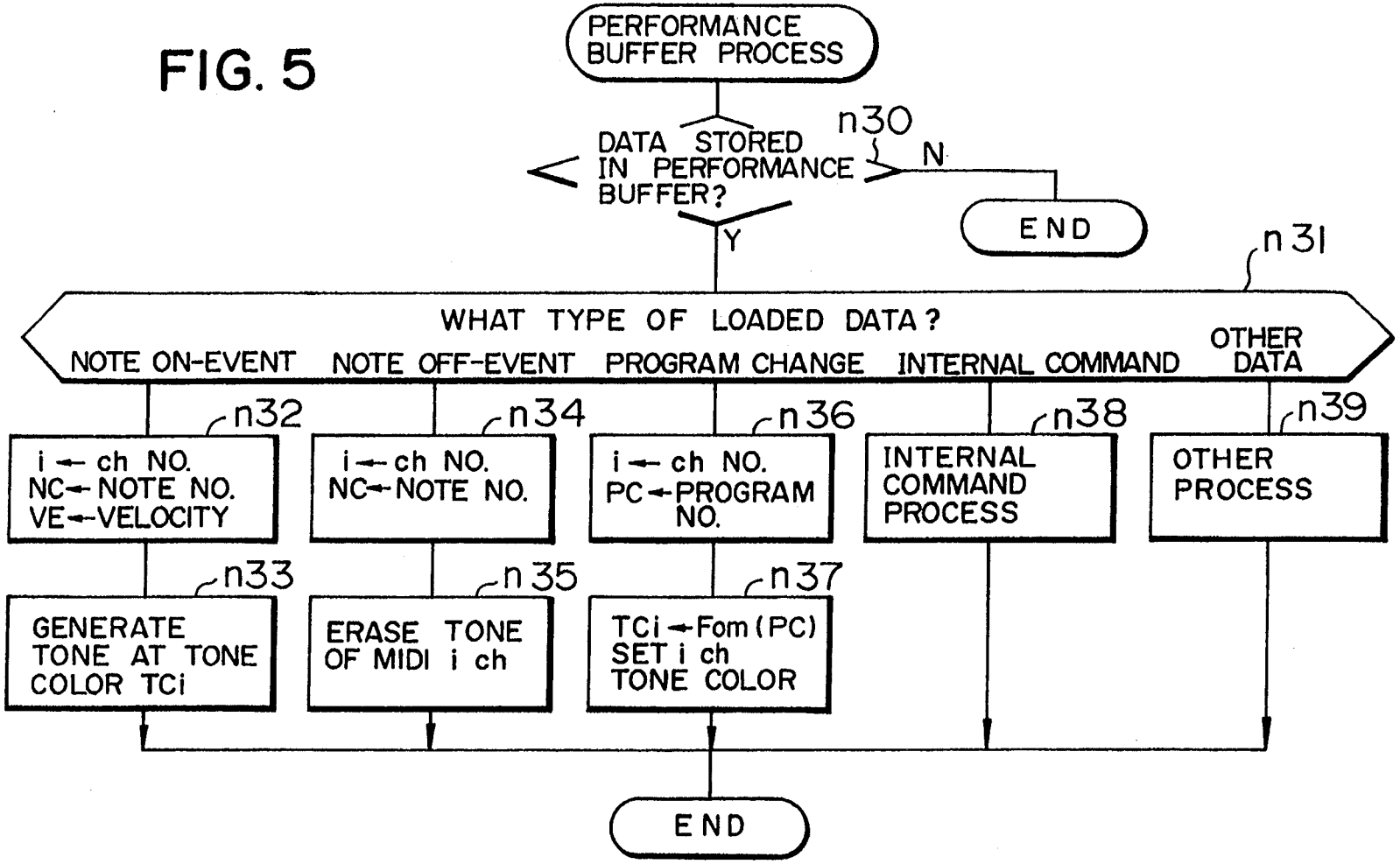
FIG. 5 is a flow chart showing the performance data buffer process of the tone signal generator unit of the embodiment.

FIG. 5 is a flow chart illustrating a performance data buffer process for executing various types of operations in accordance with the contents of data stored in the performance data buffer. It is first checked whether new data was stored in the performance data buffer (step n30). If not, the flow returns. If stored, it is checked which type the stored data is (step n31).

If the stored data is note on-event data, the number of a MIDI channel from which the data was sent is stored in the register i, the number of the on-event note is stored in the register NC, and the stored velocity data is loaded in the register VE (step n32). The MIDI channel number i identifies the designated tone color data Tci. These data are sent to the tone signal generator circuit 18 to produce a sound having the tone color Tci, tone pitch NC, and tone volume VE. The sound producing channel to be allocated is arbitrarily assigned irrespective of the MIDI channel (this is called a dynamic voice allocation).

If the stored data is a note off-event, the number of the MIDI channel from which the data was sent is stored in the register i, and the note number thereof is set to the register NC (step n34). The sound producing channel is located to stop the produced sound (step 35).

If the stored data is program change data, the number of the MIDI channel to which the program is changed is set to the register i, and the new program number is set to the register PC (step n36). Using these data as search parameters, new tone color data $F_{OM}$(PC) is read from the program change table or operation mode register OM and set to the register TCi as the tone color of the MIDI channel i for the new program number PC (step n37).

If the stored data is an internal command, the corresponding operation is performed (step n38). If the stored data is another data except the above-described data, a corresponding operation is performed (step n38). The internal commands include setting commands for setting the registers CM, OM and the like, a command for requesting a tone color and the like of a presently used channel, a command for requesting bulk dump data. The operation to be executed at step n39 includes a control change operation, all-notes-off operation, and the like.

Figure 6:
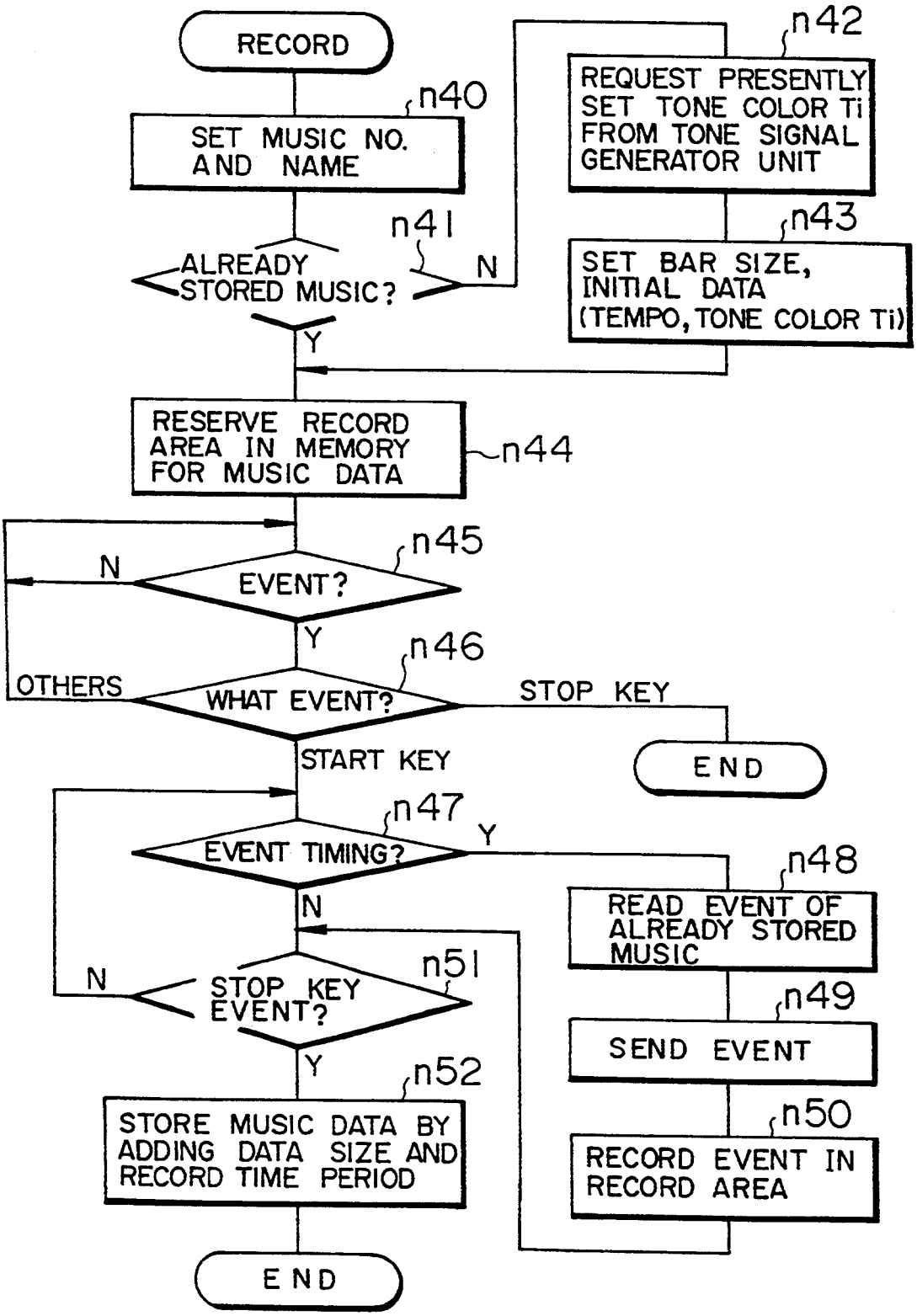
FIG. 6 is a flow chart showing a recording process for the personal computer connected to the tone signal generator unit of the embodiment.
Figure 7:
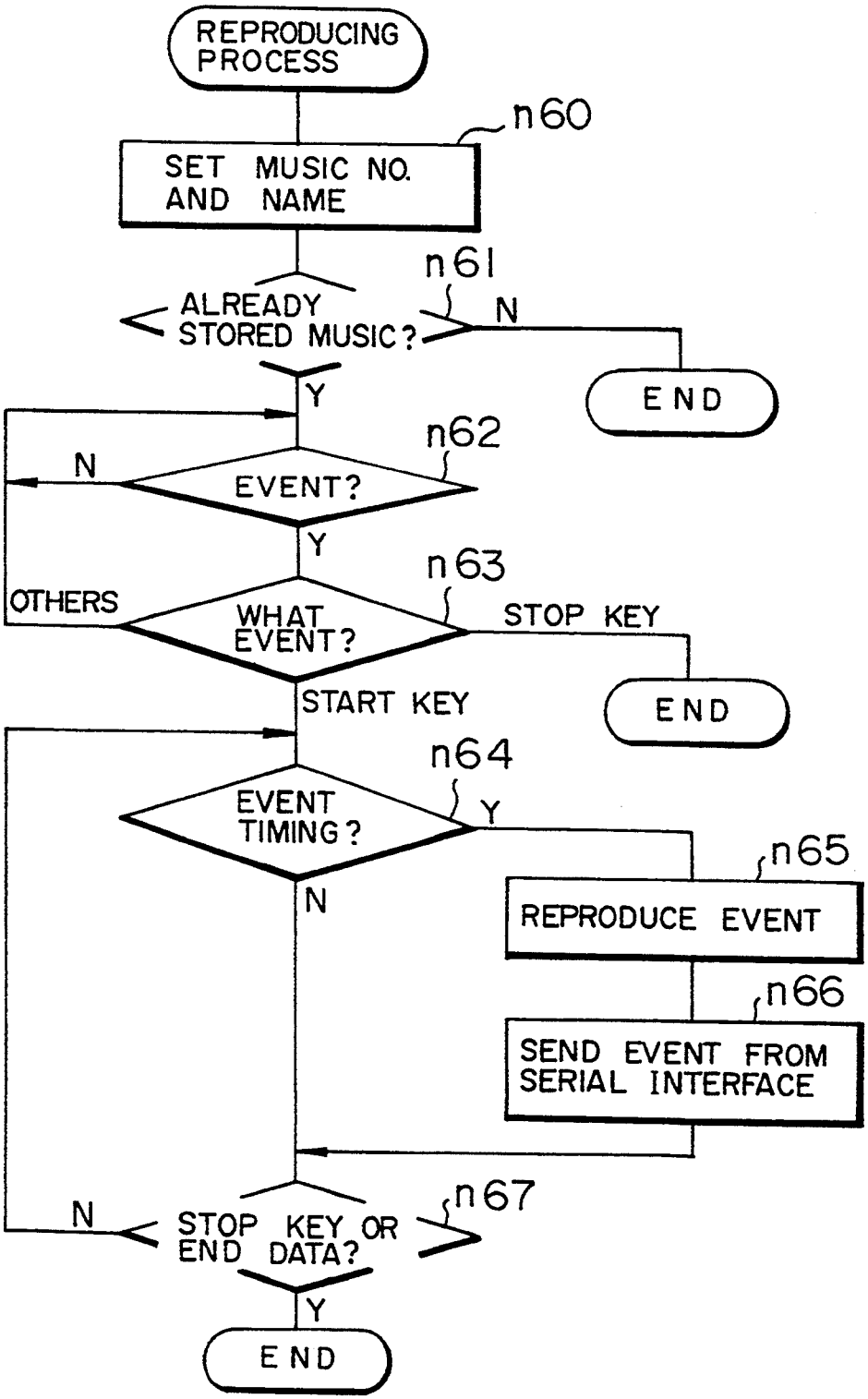
FIG. 7 is a flow chart showing a reproducing process for the personal computer connected to the tone signal generator unit of the embodiment.
Figure 8:
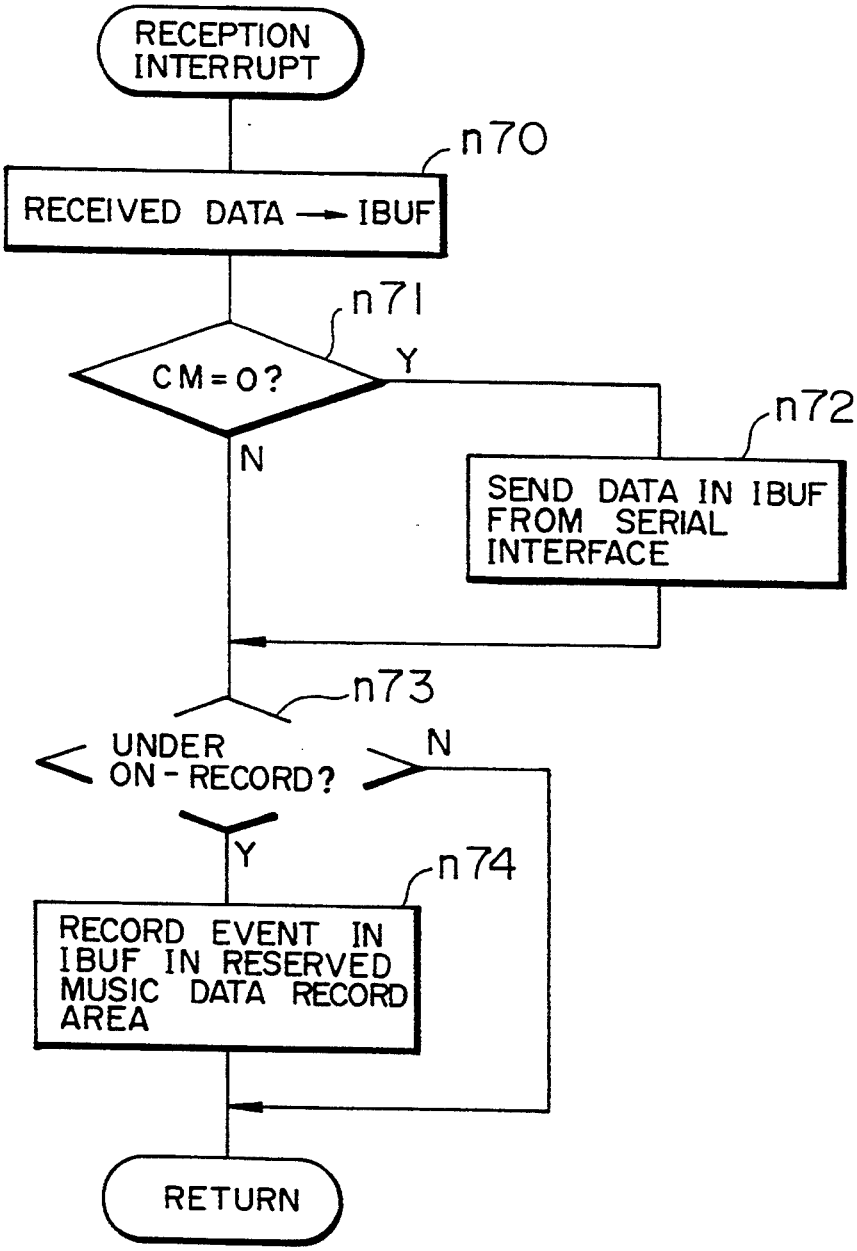
FIG. 8 is a flow chart showing a reception interrupt operation for the personal computer.

FIGS. 6 to 8 are flow charts illustrating the operations on the side of the personal computer 3.

FIG. 6 is a flow chart of a recording process wherein while reproducing automatic musical performance data already stored in a memory of the personal computer, the automatic musical performance data added with performance data hand-inputted from the controller 2 in an over-dubbing manner from the controller 2 is recorded. First, a music number and name are entered (step n40). If it is a new music, data such as tone color presently set in the tone signal generator unit is requested (step n42). This request is transmitted as an internal command. In accordance with received various setting data (such as a bar size, initial data (tempo, tone color)), various data for the new music are set (step n43). If a music already stored is to be edited, various data set for the already stored music are used and the flow advances from step n41 directly to step n44 whereat a music data record area is reserved in the memory of the personal computer. Thereafter, the flow stands by until an on-event of a start key or stop key occurs (step n45). Specific function keys of the keyboard 5 are assigned as the start key and stop key. When the on-event of the stop key occurs, the recording process is terminated. When the on-event of the start key occurs, the recording operation starts.

In the recording operation, an event timing is checked from clocks (step n47). At the event timing, the event of the already stored music is read and sent to the serial interface 15 of the tone signal generator unit 1 (step n49). This even data is sent after it is converted into the MIDI format. Thereafter, the event data is stored in the data record area reserved at step n44 (step n50). The operations from step n57 to n50 are repeated until the on-event of the stop key occurs (step n51. By repetitively performing the operations from step n47 to n51, the performance data of the music designated at step n40 can be reproduced at the tone signal generator unit 1 while recording it in the data record area reserved at step n44.

The period during such repetitive operations is discriminated as "an on-record operation". During this period, performance data supplied via the MIDI interface from the keyboard type controller 2 or the like is also stored in the data record area (which will be detailed in FIG. 8). Namely, the music reproduced by the operations from step n47 to n51 as well as the performance data input from the MIDI interface 14 is recorded in the data record area. For the case of a new music, the flow proceeds from step n47 to n51, and performance data from the MIDI interface 14 or performance data from the keyboard 5 of the personal computer 3 is recorded.

When the on-event of the stop key occurs, a header such as a music size (length of all data) and record time period is added to the recorded music data, and thereafter the record operation is terminated (step n52). In this flow, if the steps n41, n42, n48 and n44 are executed, a new music is produced and recorded, whereas if the flow advances from the step n41 directly to the step n44, the already recorded music is added with a new part (over-dubbing).

FIG. 7 is a flow chart of a reproducing process wherein an already recorded music (automatic musical performance data) is read and outputted to the tone signal generator unit 1 to reproduce the music. First, a music number and name are entered (step n60). If a new music other than those already stored in the personal computer is designated, the flow is immediately terminated (step n61). If an already stored music is designated, the flow stands by until the on-event of the start key occurs. If the stop key is turned on prior to turning on the start key, the flow is immediately terminated (step n63). When the start key is turned on, the automatic musical performance is executed. An event timing is discriminated from clocks (step n64). An event is read at the event timing (step n65), the event being outputted via the serial interface to the tone signal generator unit 1 (step n66). The serial data is converted into the MIDI data format. This operation continues until the stop key or start key is turned on (step n67). When the stop key is turned on or when the end data is read, the flow is terminated.

FIG. 8 is a flow chart showing the reception interrupt operation for serial performance data.

This operation is executed in response to a reception interrupt issued from the serial interface of the personal computer 3 while it receives data from the tone signal generator unit 1. After the received data is set to an input buffer IBUF (step n70), a CM flag is referenced (step n71). CM=0 stands for a presence of echo-back, CM=1 and CM=2 stand for an absence of echo-back. In the case of a presence of echo-back, the contents of IBUF are returned via the serial interface back to the tone signal generator unit 1 (step n72). It is then checked whether it is under the "on-record operation" (step n73). If under the on-record operation, the event stored in the input buffer IBUF is recorded in the data record area reserved at the step n44 (FIG. 6) (step n74).

The "on-record operation" corresponds, in the case of an existing song, to the repetitive operations from the step n47 to n51 shown in FIG. 6. In the case of the over-dubbing operation, the event in the input buffer IBUF as well as the music being reproduced at the repetitive operations is stored in the data record area. In the case of a new music, only the new musical performance data is stored in the data record area.

With the above-described operations, the tone signal generator unit 1 can generate tone signals by using data received either from the MIDI interface 14 (keyboard type controller 2) or from the serial interface 15 (personal computer 3). Data received from the MIDI interface can be directly supplied via the serial interface to the personal computer 3 without using a specific conversion board.

The tone signal generator unit of the embodiments described above is accompanied with a separate keyboard and a separate sound system. It may also be such a structure as an electronic musical instrument, which integrally includes a keyboard and a sound system.

Although the present invention has been described in connection with the preferred embodiments, the present invention is not intended to be limited only to those embodiments. For example, it is apparent that various changes, improvements, combinations and the like can be made by those skilled in the art.

I claim:

1. A tone signal generator unit comprising:

bi-directional serial communication means for transmitting and receiving information including musical performance data to and from a personal computer;

electronic musical instrument serial communication means for communicating with an electronic musical instrument including serial input means for receiving information including musical performance data from an electronic musical instrument and serial output means adapted for transmitting information including musical performance data to another electronic musical instrument;

tone signal generation means for generating tone signals based on musical performance data received by either said bi-directional serial communication means and the musical performance data received by said electronic musical instrument serial communication means;

mode selection means for selecting one of a plurality of communication modes; and communication control means for controlling communication of information including musical performance data between said bi-directional serial communication means, said electronic musical instrument serial communication means and said tone signal generation means according to the selected communication mode.

2. A tone signal generator unit according to claim 1, wherein said bi-directional serial communication means includes means, responsive to receipt of selected information from said personal computer, for providing said electronic musical instrument serial communication means with at least a portion of said selected information, said serial communication means including means for transmitting said selected information via said serial output means to said another electronic musical instrument in accordance with the selected communication mode, and wherein said electronic musical instrument serial communication means includes means, responsive to information received from the electronic musical instrument, for providing said bi-directional serial communication means with the information so as to transmit the information to the personal computer in accordance with the selected communication mode.

3. A tone signal generator unit according to claim 1, wherein said serial input means includes first means, responsive to selection of a first communication mode, for providing the received information to said bi-directional serial communication means and said tone signal generation means such that the bi-directional serial communication means transmits the provided information to the personal computer and the tone signal generation means generates tone signals corresponding to the provided information, and second means, responsive to selection of a second communication mode, for providing the received information only to said tone signal generation means so that the tone signal generation means generates tone signals corresponding to the provided information.

4. A tone signal generator unit according to claim 1, wherein said serial input means includes first means, responsive to selection of a first communication mode, for providing the received information to said bi-directional serial communication means and said tone signal generation means such that the bi-directional serial communication means transmits the provided information to the personal computer and the tone signal generation means generates tone signals corresponding to the provided information, and second means, responsive to selection of a second communication mode, for providing the received information only to said bi-directional serial communication means so that the bi-directional serial communication means transmits the provided information to the personal computer.

5. A tone signal generator unit according to claim 1, wherein said bi-directional serial communication means includes means, responsive to selection of a first communication mode, for receiving information from the personal computer and providing said received information to said electronic musical instrument serial communication means and said tone signal generation means such that the serial communication means transmits the provided information from the serial output means to said another electronic musical instrument and the tone signal generation means generates tone signals corresponding to the provided information.

6. A tone signal generator unit according to claim 1, wherein said communication control means includes means for determining, in accordance with the selected communication mode, that information received by the serial input means of said electronic musical instrument serial communication means is to be provided to said bi-directional serial communication means, that the information received by the bi-directional serial communication means is to be provided to the electronic musical instrument serial communication means and that the information received by one of the electronic musical instrument serial communication means and bi-directional serial communication means is to be provided to the tone signal generation means.

7. A tone signal generator unit according to claim 1, wherein said serial input means includes means, responsive to selection of a first communication mode, for providing the received information only to said tone signal generation means so that the tone signal generation means generates tone signals corresponding to the provided information, and means, responsive to selection of a second communication mode, for providing the received information only to said bi-directional serial communication means for transmission to the personal computer.

* * * * *